US006485103B1

(12) United States Patent
Yamada et al.

(10) Patent No.: US 6,485,103 B1
(45) Date of Patent: Nov. 26, 2002

(54) STRUCTURAL UNIT HAVING NET MEMBER INCORPORATED THEREIN, SEAT AND METHOD FOR TREATING END SECTION OF NET MEMBER

(75) Inventors: Toshihiko Yamada, Hiroshima (JP); Etsunori Fujita, Hiroshima (JP); Yumi Ogura, Hiroshima (JP); Kazuyoshi Chizuka, Hiroshima (JP); Hiroki Oshimo, Hiroshima (JP)

(73) Assignee: Delta Tooling Co., Ltd., Hiroshima (JP)

( * ) Notice: Subject to any disclaimer, the term of this patent is extended or adjusted under 35 U.S.C. 154(b) by 0 days.

(21) Appl. No.: 09/620,829

(22) Filed: Jul. 21, 2000

(30) Foreign Application Priority Data

Jul. 21, 1999 (JP) ..... 11-206914

(51) Int. Cl.[7] ..... A47C 31/02

(52) U.S. Cl. ..... 297/452.56; 297/452.38; 297/218.3

(58) Field of Search ..... 297/452.38, 452.56, 297/452.64, 218.3; 156/73.6, 93, 148, 309.6

(56) References Cited

U.S. PATENT DOCUMENTS 3,024,068 A * 3/1962 Eames ..... 297/452.13
3,610,689 A * 10/1971 Smith ..... 297/452.41
3,981,534 A * 9/1976 Wilton ..... 297/218.1
4,588,229 A * 5/1986 Jay ..... 297/252.25
4,826,249 A * 5/1989 Bradbury ..... 297/452.41
4,883,320 A * 11/1989 Izumida et al. ..... 297/452.56

FOREIGN PATENT DOCUMENTS

JP 10-276854 A * 10/1998 ..... A47C/5/06
JP WO-99-20159 A1 * 4/1999 ..... A47C/27/00

* cited by examiner

*Primary Examiner*—Peter M. Cuomo
*Assistant Examiner*—Joseph Edell
(74) *Attorney, Agent, or Firm*—Steinberg & Raskin, P.C.

(57) ABSTRACT

A structural unit having a net member incorporated therein capable of preventing local application of undue force to the net member, to thereby increase reliability of the net member. An end section of a net member of a three-dimensional structure is treated so as to be reduced in cushioning characteristics and increased in hardness as compared with a portion of the net member positioned inside the end section. A frame constituting a part of the structural unit is provided with an end holding member so that an insertion port of an insertion gap of the end holding member is arranged in a particular direction or posture, resulting in the end section being readily held in the holding member by merely inserting the end section in the insertion gap. The end section is entirely inserted into the insertion gap, so that application of load to the end section may be carried out in a two-dimensional manner rather than a spot-like manner. This prevents local application of load to the net member, to thereby keep the net member from damage thereto.

8 Claims, 9 Drawing Sheets

(a)

(b)

STRUCTURAL UNIT HAVING NET MEMBER INCORPORATED THEREIN, SEAT AND METHOD FOR TREATING END SECTION OF NET MEMBER

BACKGROUND OF THE INVENTION

This invention relates to a structural unit having a net member of a three-dimensional structure incorporated therein, a sheet constructed of such a structural unit and a method for treating an end section of the net member.

A seat which is required to exhibit increased cushioning characteristics such as a seat for an automobile or the like is generally constructed in such a manner that a spring member such as a coiled spring, an S-shaped spring or the like is arranged on a seat frame, a pad member made of urethane resin or the like is arranged on the spring member and then a vinyl leather material, a fabric or the like overlies a front surface of the pad member. However, the seat thus constructed is increased in thickness and weight due to incorporation of the spring member therein. Also, the conventional seat is generally deteriorated in air permeability or ventilation unless any specific means such as formation of ventilation holes through the pad member is applied thereto. Such specific means for realizing ventilation in the seat causes an increase in manufacturing cost of the seat.

In order to solve the above-described problem, a seat was proposed which includes a net member of a truss structure (three-dimensional structure) constructed of a front mesh layer, a rear mesh layer and a plurality of piles arranged between the front mesh layer and the rear mesh layer to connect both mesh layers to each other therethrough. The truss structure permits the net member to be constructed into a resilient or elastic structure which is resistant to setting, so that the net member may exhibit characteristics of sufficiently dispersing and absorbing a pressure of the body. Thus, it exhibits significant cushioning characteristics while being formed into a reduced thickness. Also, it is constructed into a network structure, to thereby be provided therein with a number of voids, resulting in exhibiting good air permeability without providing any specific ventilation means therein.

Although the net member thus constructed into a three-dimensional structure exhibits such characteristics as described above, it not only has a number of the voids formed therein but is formed into a substantially increased thickness because of including the piles formed into a height in addition to the front mesh layer and rear mesh layer each formed into a thickness, so that it is substantially difficult to securely fix the net member to the frame. Conventionally, such fixing is generally carried out in such a manner as shown in FIG. 12. More specifically, an element 102 made of synthetic resin or iron is welded to an end section 101 of a net member 100 by vibration welding which is a kind of heat welding and then the net member 100 is fixed to a frame 104 by means of a screw 103 through the end section 101 having the resin or iron element 102 welded thereto.

However, such fixing is carried out in the form of a spot fastening; therefore, when load is applied to the net member 100 acting as a cushioning member for a seat due to sitting-down of a person on the net member or the like, the resin or iron element 102 fastened to the net member 100 through the screw 103 is exposed to stress at an increased magnitude. This possibly causes deformation of the resin or iron element 102 and/or damage to the net member 100. Thus, it should be avoided to apply load at a large magnitude to the net member 100. Also, such fixing or fastening by means of the screw 103 causes assembling of the seat to be troublesome, leading to an increase in manufacturing cost of the seat.

SUMMARY OF THE INVENTION

The present invention has been made in view of the foregoing disadvantage of the prior art.

Accordingly, it is an object of the present invention to provide a structural unit having a net member of a three-dimensional structure incorporated therein which is capable of preventing such application of local load or stress thereto as encountered in a net member using a fastening screw, to thereby enhance reliability of the net member.

It is another object of the present invention to provide a structural unit having a net member of a three-dimensional structure incorporated therein which is capable of facilitating assembling thereof and reducing a manufacturing cost thereof.

It is a further object of the present invention to provide a structural unit having a net member of a three-dimensional structure incorporated therein which is suitable for use for a seat for a vehicle or the like.

It is still another object of the present invention to provide a seat which is constructed of such a structural unit as described above.

It is yet another object of the present invention to provide a method for treating an end of a net member.

In accordance with one aspect of the present invention, a structural unit having a net member incorporated therein is provided. The structural unit includes a net member of a three-dimensional structure constituted by a front mesh layer, a rear mesh layer and a plurality of piles arranged between the front mesh layer and the rear mesh layer so as to connect the front mesh layer and rear mesh layer to each other therethrough. The net member is formed on a periphery thereof with an end section. The structural unit also includes an end holding member for supporting the end section of the net member therein. The end holding member includes a holding element formed therein with an insertion gap into which the end section of the net member is inserted. The end section of the net member is treated so that at least a part thereof has a net structure increased in density and rigidity as compared with a portion of the net member positioned inside the end section, resulting in being held in the end holding member due to insertion thereof into the insertion gap of the end holding member.

Also, in accordance with this aspect of the present invention, a structural unit having a net member incorporated therein is provided. The structural unit includes a net member of a three-dimensional structure constituted by a front mesh layer, a rear mesh layer and a plurality of piles arranged between the front mesh layer and the rear mesh layer so as to connect the front mesh layer and rear mesh layer to each other therethrough. The net member is formed on a periphery thereof with an end section. The structural unit also includes an end holding member for supporting the end section of the net member therein. The end holding member includes a holding element formed therein with an insertion gap into which the end section of the net member is inserted. The end section of the net member is fixedly mounted on at least a part thereof with a synthetic resin element by heat welding, so that the part of the end section on which the synthetic resin element is mounted is inserted into the insertion gap of the end holding member, resulting in the end section being held in the end holding member.

Further, in accordance with this aspect of the present invention, a structural unit having a net member incorporated therein is provided. The structural unit includes a net member of a three-dimensional structure constituted by a front mesh layer, a rear mesh layer and a plurality of piles arranged between the front mesh layer and the rear mesh layer so as to connect the front mesh layer and rear mesh layer to each other therethrough. The net member is formed on a periphery thereof with an end section. The structural unit also includes an end holding member for supporting the end section of the net member therein. The end holding member includes a holding element formed therein with an insertion gap into which the end section of the net member is inserted. The end section of the net member is treated so that a part thereof has a net structure increased in density and rigidity as compared with a portion of the net member positioned inside the end section and the end section is fixedly mounted on another part thereof with a synthetic resin element by heat welding, so that the parts of the end section may be held in the end holding member due to insertion thereof into the insertion gap of the end holding member.

In a preferred embodiment of the present invention, the insertion gap of the end holding member has an insertion port arranged in a posture which permits the end section of the net member to be inserted into the insertion gap therethrough while keeping the end section inwardly folded when the net member is arranged in contact with an outer surface of the net member.

In a preferred embodiment of the present invention, wherein the end section treated so that the net structure is increased in density and rigidity is formed on at least one surface thereof with a projection. The holding element is provided thereon with a pawl in a manner to project into the insertion gap of the end holding member. The end section is inserted into the insertion gap so that the projection is positioned deeply beyond the pawl in the insertion gap, resulting in being held in the insertion gap.

In a preferred embodiment of the present invention, the part of the end section treated so that the net structure is increased in density and rigidity is held in the end holding member positioned on a side on which stress occurring is reduced and the part of the end section mounted thereon with the synthetic resin element is held in the end holding member positioned on a side on which stress occurring is increased.

In a preferred embodiment of the present invention, the end section is treated so as to be reduced in thickness by heat welding, so that the net structure is increased in density and rigidity.

In a preferred embodiment of the present invention, the end section is subject to the heat welding after it is previously knitted so as to increase density of the net structure.

In a preferred embodiment of the present invention, the heat welding is carried out by vibration welding.

In accordance with another aspect of the present invention, a seat is provided. The seat is constituted by the structural unit constructed as described above.

In a preferred embodiment of the seat of the present invention, the end section treated so as to increase density and rigidity of the net structure is held in the end holding member connected to a frame forwardly arranged and the end section on which the synthetic resin element is mounted is held in the end holding member connected to a frame rearwardly arranged.

In a preferred embodiment of the seat of the present invention, the end section held in the end holding member connected to a frame laterally arranged is treated so that a net structure thereof is increased in density and rigidity, and is held in the end holding member after it is provided with the projection.

In accordance with a further aspect of the present invention, a method for treating an end section of a net member is provided. The method includes the step of reducing a thickness of an end section formed on a periphery of a net member of a three-dimensional structure by heat welding so as to hold the end section in an end holding member, resulting in a net structure of the end section being increased in density and rigidity as compared with a portion of the net member positioned inside the end section, wherein the net member is constituted by a front mesh layer, a rear mesh layer and a plurality of piles arranged between the front mesh layer and the rear mesh layer so as to connect the front mesh layer and rear mesh layer to each other therethrough.

In a preferred embodiment of the method of the present invention, the end section is subject to the heat welding after it is previously knitted so as to increase density of the net structure.

In a preferred embodiment of the method of the present invention, the end section is formed thereon with a projection in a manner to project in a thickness direction thereof during heat welding of the end section.

In a preferred embodiment of the method of the present invention, the heat welding is carried out by vibration welding.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 11(*b*) is a fragmentary side elevation view of the end holding member shown in FIG. 11(*a*)

DETAILED DESCRIPTION OF THE PREFERRED EMBODIMENTS

Now, the present invention will be described hereinafter with reference to FIGS. 1 to 11(*b*).

Figure 1:
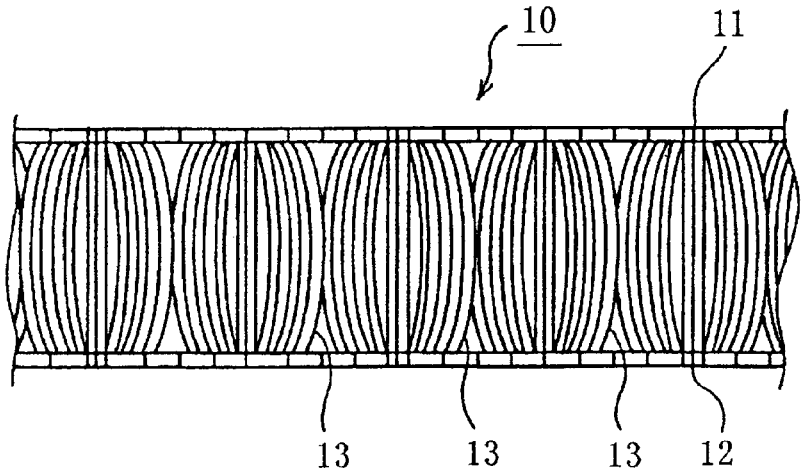
FIG. 1 is a fragmentary schematic sectional view showing a net member constituting a structural unit according to an embodiment of the present invention.

Referring first to FIG. 1, a net member constituting a part of a structural unit according to an embodiment of the present invention is illustrated. The net member generally designated at reference numeral 10 is constructed into a stereo truss structure (three-dimensional structure) which includes a front mesh layer 11, a rear mesh layer 12 and a number of piles 13 arranged between the front mesh layer 11 and the rear mesh layer 12 to connect both mesh layers 11 and 12 to each other therethrough.

Figure 2:
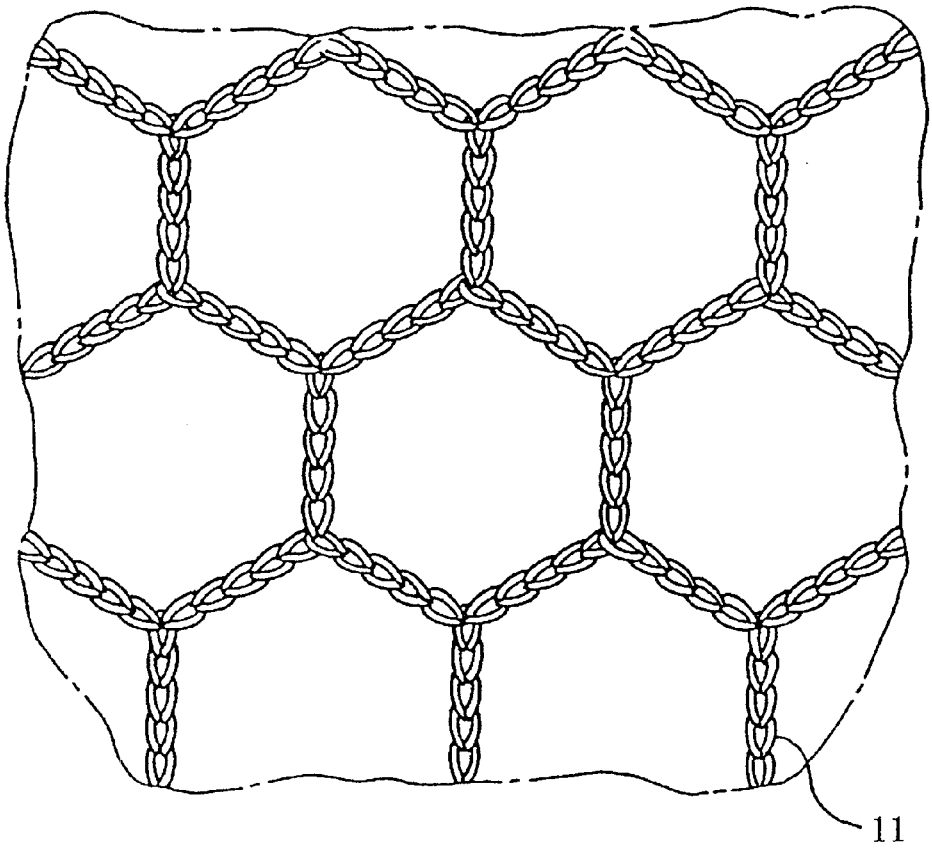
FIG. 2 is a fragmentary enlarged view showing a front mesh layer of the net member of FIG. 1.
Figure 3:
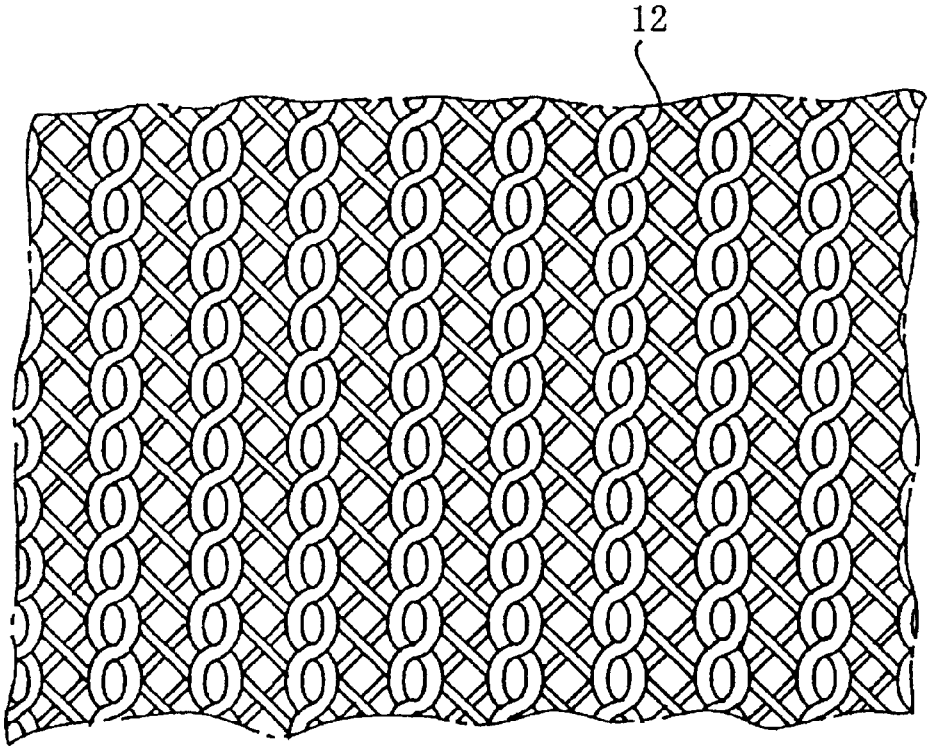
FIG. 3 is a fragmentary enlarged view showing a rear mesh layer of the net member of FIG. 1.

The front mesh layer 11, as shown in FIG. 2 by way of example, is formed of a twisted yarn made by twisting fine filaments into a honeycomb (hexagonal) mesh structure. The rear mesh layer 12, as shown in FIG. 3, is formed by subjecting a twisted yarn made by twisting fine filaments to rib knitting and constructed into a structure of a mesh smaller than that of the honeycomb mesh of the front mesh layer 11. The piles 13 each are formed of either a fiber or a yarn and knitted between the front mesh layer 11 and the rear mesh layer 12 so as to hold both mesh layers 11 and 12 separated from each other at a predetermined interval, resulting in providing the net member 10 of a stereo mesh knit structure with rigidity at a predetermined level. In the illustrated embodiment, the layer having the honeycomb mesh forms a front surface of the net member 10 or a layer contacted with the human body, for example, when the net member 10 is used as a cushioning member for a seat. Alternatively, the layer may be arranged so as to form a rear surface of the net member 10. Also, as shown in Table 1 described below, the mesh layer of course may be formed into any suitable mesh configuration other than a honeycomb configuration and a gauze configuration.

The net member 10 may be preferably formed of a thermoplastic resin material. It is merely required that the thermoplastic resin is formed into a fiber-like configuration and exhibits strength required for a seat when it is formed into a woven fabric. Thus, the thermoplastic resins include, for example, thermoplastic polyester resins represented by polyethylene terephthalate (PET), polybutylene terephthalate (PBT) and the like; polyamide resins represented by nylon 6, nylon 66 and the like; polyolefin resins represented by polyethylene, polypropylene and the like; and any suitable mixture of the resins described above.

The piles each may have a thickness of 380 d or more and preferably 600 d or more. Such construction of net member 10, when a person sits down on the net member 10 used as a cushioning member for a seat, permits load of the person applied to the net member 10 to be effectively dispersed due to deformation of the mesh and falling-down of the piles 13, resulting in providing a flexible structure which prevents stress concentration.

Table 1 shows materials used which may be for the net member 10 and physical properties thereof by way of example for reference.

TABLE 1

| Number | 1 | 2 | 3 | 4 | 5 | 6 |
|---|---|---|---|---|---|---|
| Material | nylon | polyester | ← | ← | ← | ← |
| Weight (g/m$^2$) | 888 | 784 | 864 | 984 | 876 | 1128 |
| Density | | | | | | |
| *1 | 8.0 | 7.5 | ← | 8.5 | 7.0 | 8.5 |
| *2 | 14.0 | 13.0 | ← | ← | 14.0 | 13.0 |
| Thickness of yarn | | | | | | |
| *3 | 220d/1f | 1300d/96f | ← | ← | ← | ← |
| *4 | | 500d/70f | ← | ← | ← | ← |
| *5 | 880d/1f | 600d/1f | ← | ← | 800d/1f | ← |
| Tensile strength (kg/5 cm) | | | | | | |
| *6 | 38.0 | 156.9 | 158.4 | 152.1 | 148.7 | 159.3 |
| *7 | 24.8 | 62.1 | 79.4 | 136.5 | 57.5 | 130.1 |
| Elongation (%) | | | | | | |
| *6 | 111.1 | 56.2 | 62.5 | 48.3 | 50.1 | 50.2 |
| *7 | 189.3 | 66.4 | 68.2 | 43.3 | 78.0 | 40.0 |
| Peel strength (kg) | | | | | | |
| *6 | 33.8 | 87.9 | 79.2 | 75.0 | 91.1 | 77.7 |
| *7 | 26.2 | 49.2 | 44.9 | 63.7 | 41.1 | 66.7 |
| Distortion rate by repeated load | | | | | | |
| *6 | — | 2.6 | ← | 2.7 | 1.4 | 1.2 |
| *7 | — | 10.6 | 2.7 | 5.6 | 4.6 | 0.2 |
| Resistance to wear | | | | | | |
| *6 | — | 4.5 | ← | ← | ← | ← |
| *7 | — | 4.0 | ← | 4.5 | ← | ← |
| Structure of mesh layer | | | | | | |
| *8 | mesh | honeycomb | ← | mesh | honeycomb | mesh |

TABLE 1-continued

| Number | 1 | 2 | 3 | 4 | 5 | 6 |
|---|---|---|---|---|---|---|
| *9 Pile structure | mesh parallel | gauze cross | ← parallel | gauze cross | gauze parallel | gauze cross |

*1 Longitudinal (/inch)
*2 Lateral (/inch)
*3 Front surface
*4 Rear surface
*5 Pile
*6 Longitudinal
*7 Lateral
*8 Front
*9 Rear In Table 1, "d" indicates a unit "denier". "1 d" indicates a thickness of a yarn obtained when the yarn of 1 g in an amount is elongated by 9,000 m. Thus, for example, "220 d" indicates a thickness of a yarn obtained when the yarn of 1 g in an amount is elongated by 9,000/220=40.9 m. "f" indicates the number of fine filaments constituting a single yarn. Thus, for example, "70f" indicates that a single yarn is constituted by 70 fine filaments. "kg/5 cm" referred to in connection with tensile strength indicates tensile strength of the net member obtained when the member of 5 cm in width is pulled. "Parallel" in connection with the pile structure indicates that the piles 13 for connecting the front mesh layer 11 and rear mesh layer 12 to each other do not intersect each other as viewed from the side and "cross" indicates that both intersect each other as viewed from the side.

Now, an end holding member 20 for holding an end section 15 (FIG. 7) defined on a peripheral edge of the net member 10 in a frame 30 therethrough will be described with reference to FIGS. 4(*a*) to 5(*c*). The end holding member 20 is fixed on an outer surface of the frame 30 formed of a pipe material or the like so as to constitute a seat or the like. The fixing may be attained by spot welding carried out along the frame 30 or by means of bolts arranged along the frame 30. The end holding member 20 may be constructed into any desired configuration so long as it is provided with an insertion gap 21 which permits the end section 15 of the net member 10 to be inserted thereinto.

Figure 4:
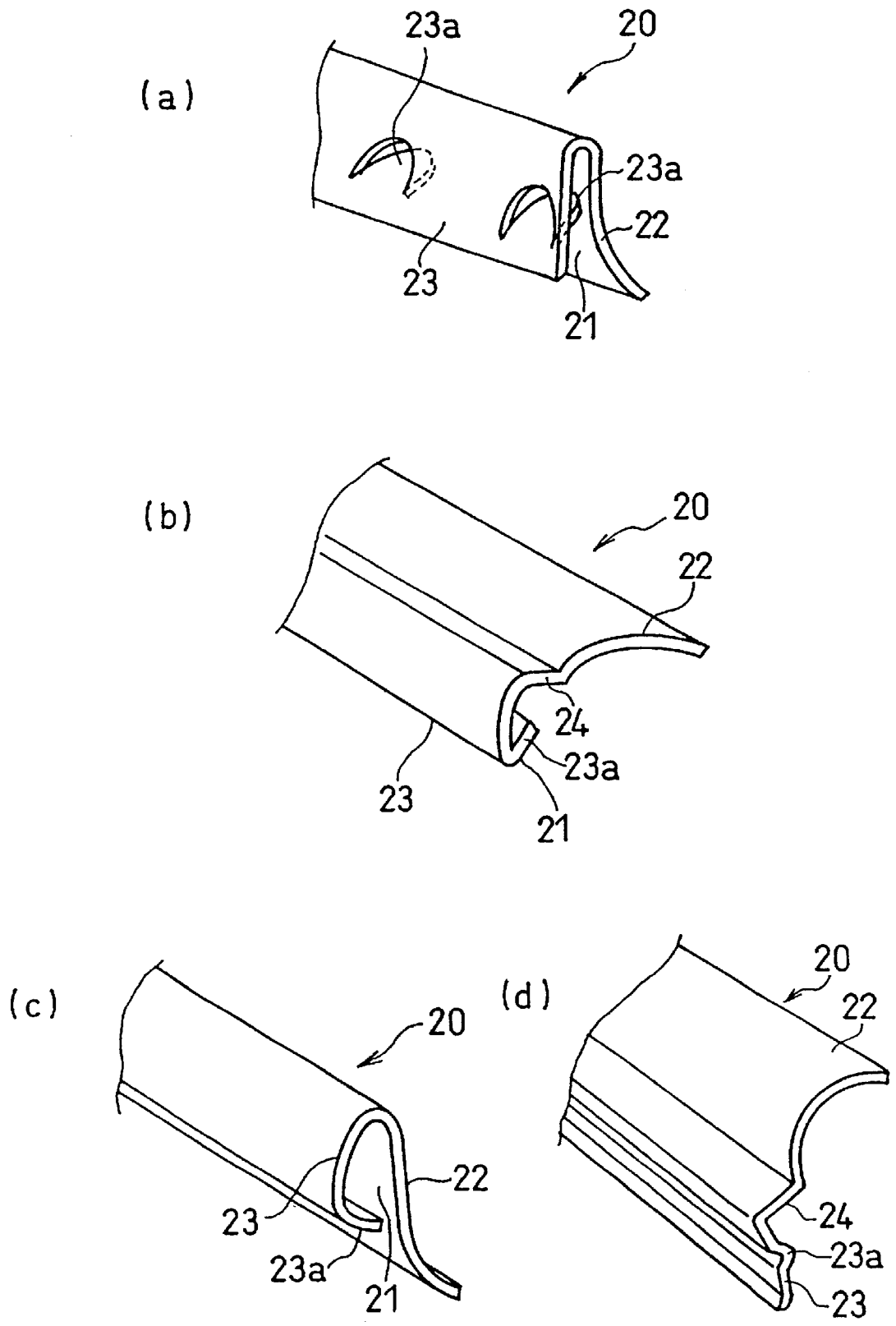
FIGS. 4(*a*) to 4(*d*) each are a fragmentary schematic perspective view showing an end holding member incorporated in a structural unit according to an embodiment of the present invention by way of example.

An end holding member 20 shown in FIGS. 4(*a*) and 5(*a*) includes a base element 22 formed with a curved surface so as to be joinable to an outer surface of the frame 30 along the outer surface and a holding element 23 formed so as to downwardly extend from an upper end of the base element 22 and arranged so as to face the base element 22 with a gap being defined therebetween. The gap thus defined between the base element 22 and the holding element 23 acts as an insertion gap 21. The holding element 23 is provided with a plurality of pawls 23*a* in a manner to be spaced from each other at predetermined intervals in a longitudinal direction of the end holding member 20 and therefore the holding element 23. The pawls 23*a* each are formed by forming a cut of, for example, a substantially U-shape through the holding element 23 and then projecting a U-shaped portion of the holding element 23 thus cut toward the insertion gap 21 while bending it. The pawls 23*a* may be formed into any desired width.

An end holding member 20 shown in FIGS. 4(*b*) and 5(*b*) includes a base element 22 formed with a curved surface so as to be joinable to the outer surface of the frame 30 along the outer surface, a projection element 24 bent so as to outwardly extend from a lower end of the base element 22, and a holding element 23 arranged so as to downwardly extend from an outer end of the projection element 24 while being kept parallel to the outer surface of the frame 30, wherein an insertion gap 21 is defined between an inner surface of the holding element 23 and the outer surface of the frame 30. The holding element 23 is formed on the inner surface thereof with a pawl 23*a* in a manner to upwardly obliquely extend therefrom toward the insertion gap 21. The pawl 23*a* may be formed into any desired width or length defined in a longitudinal direction of the holding element 23. Thus, it may be formed over a whole length of the holding element 23. Alternatively, it may be formed so as to extend over a part of the holding element 23.

An end holding member 20 shown in FIGS. 4(*c*) and 5(*c*) includes a base element 22 formed with a curved surface so as to be joinable to the outer surface of the frame 30 along the outer surface, a holding element 23 formed so as to downwardly extend from an upper end of the base element 22 and arranged so as to face the base element 22 with a gap being defined therebetween, and a pawl 23*a* formed by bending a lower end of the holding element 23 inwardly or toward the gap. The gap defined between the base element 22 and the holding element 23 likewise provides an insertion gap 21 as in the end holding member shown in FIGS. 4(*a*) and 5(*a*).

An end holding member 20 shown in FIG. 4(*d*) includes a base element 22 formed with a curved surface so as to be joinable to the outer surface of the frame 30 along the outer surface, a projection element 24 connected to a lower end of the base element 22 so as to outwardly extend therefrom, and a holding element 23 connected to an outward end of the projection element 24 so as to downwardly extend therefrom substantially in parallel to the outer surface of the frame 30. An insertion gap 21 is defined between an inner surface of the holding element 23 and the outer surface of the frame 30. The holding element 23 is formed on an intermediate portion thereof with a pawl 23*a* in a manner to project or extend toward the insertion gap 21 by caulking using a hammering device or the like.

The insertion gap 21 of the end holding member 20 has an insertion port 21*a* provided at an inlet thereof. The insertion port 21*a* may be formed so as to permit the end section 15 of the net member 10 to be inserted therethrough into the insertion gap 21 while being inwardly bent when the net member 10 is positioned in alignment with an outer surface of the holding element 23. More specifically, the insertion port 21*a* may be so arranged that application of load to the net member 10 causes the end section 15 of the net member 10 to be pulled toward a point or position at which application of load to the net member 10 is carried out, during which the end section 15 of the net member 10 is abutted against the inner surface of the holding element 23, to thereby prevent the end section 15 from being removed from the insertion gap 21. For example, when the net member 10 is stretchedly arranged so as to extend through an upper portion of the outer surface of the frame 10 as shown in each of FIGS. 5(*a*) to 5(*c*), the insertion port 21*a* of the insertion gap 21 is downwardly directed so as to ensure that the end section 15 of the net member 10 is upwardly inserted through the insertion port 21*a* into the insertion gap 21 after a portion of the net member 10 adjacent to the end section 15 is positioned in alignment with the outer surface of the holding element 23. The end holding member 20 may be constructed in any desired manner so long as it permits the end section 15 of the net member 10 to be inserted into the insertion gap 21 in such a manner as described above. Thus, it is not limited to the construction shown in FIGS. 4(*a*) to 5(*c*).

Now, a treatment of the end section 15 of the net member 10 which is carried out in order to ensure that the end section 15 of the net member 10 is inserted into the insertion gap 21 for the purpose of fastening the net member 10 to the frame 30 will be described. As described above, in the illustrated embodiment, it is required that the end section 15 of the net member 10 is held in the holding element 23 while being abutted against the holding element 23 when tension is applied to the end section 15 due to application of load thereto while keeping the end section 15 inserted into the insertion gap 21 of the end holding member 20. Thus, in the net member 10, it is required that a portion of the net member 10 to which load is applied such as, for example, a portion thereof on which a person is sit down when the net member is used as a seat exhibits a sufficient degree of cushioning characteristics, whereas the end section 15 is hardened to a degree.

Figure 7:
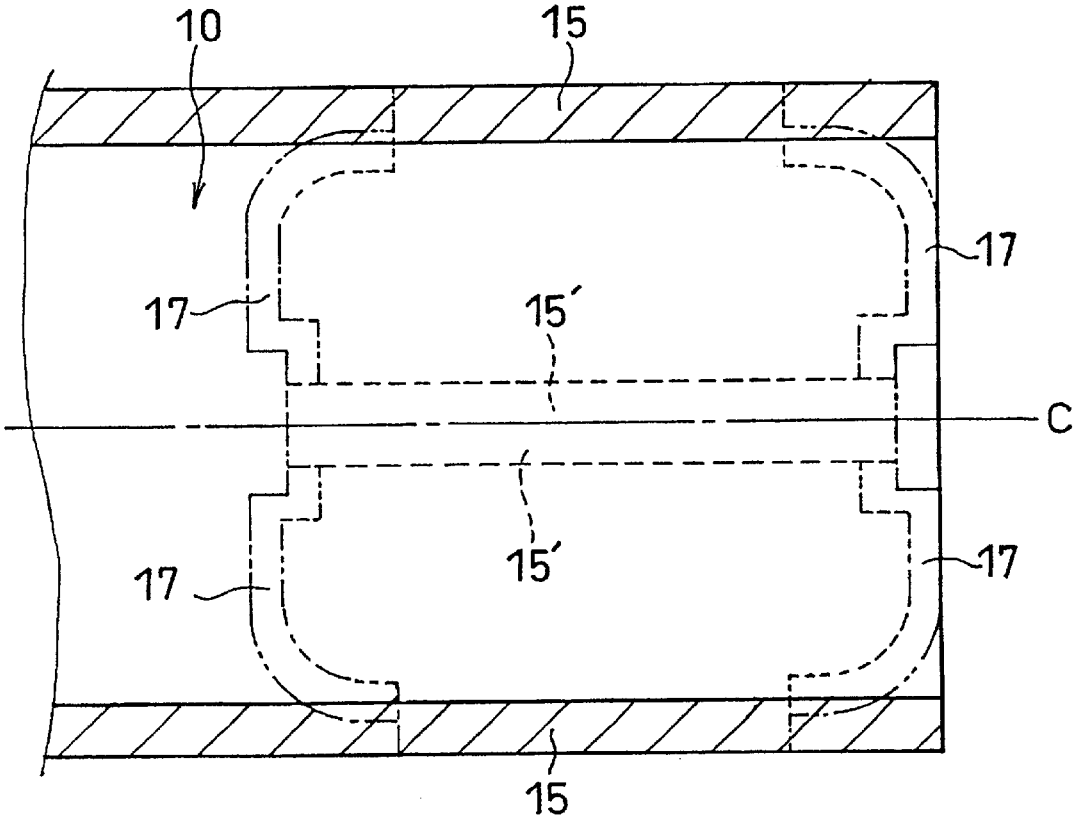
FIG. 7 is a fragmentary schematic sectional view showing a net member.

Now, hardening of the end section 15 of the net member 10 will be described. A first method for this purpose is to subject the end section 15 to heat welding to reduce a thickness thereof, resulting in increasing density and rigidity of the end section 15. More particularly, the end section 15 of the net member 10 is subjected to heat welding, to thereby attain mutual bonding or joining between the piles 13, between the front mesh layer 11 and the piles 13, between the rear mesh layer 12 and the piles 13 and between the front mesh layer 11 and the rear mesh layer 12, resulting in being reduced in thickness. This permits the end section 15 of the net member 10 to be formed or changed into a plate-like configuration while reducing a size of the voids in the end section, resulting in cushioning characteristics of the end section 15 being substantially eliminated and rigidity thereof being significantly increased. In this respect, as shown in FIG. 7, it is preferable that knitting of the net member 10 is carried out so as to permit only a portion of the net member 10 constituting the end section 15 to have density increased as compared with the remaining portion thereof and then the end section 15 is subjected to heat welding to reduce a thickness thereof. Such knitting of the net member 10 which causes the portion of the net member 10 corresponding to the end section 15 to be increased in density is carried out for the reason that it permits density in the above-described mutual joining among the front mesh layer 11, rear mesh layer 12 and piles 13 to be increased, to thereby provide the end section 15 with highly increased rigidity, when the end section 15 is subjected to heat welding for a reduction in thickness.

Figure 5:
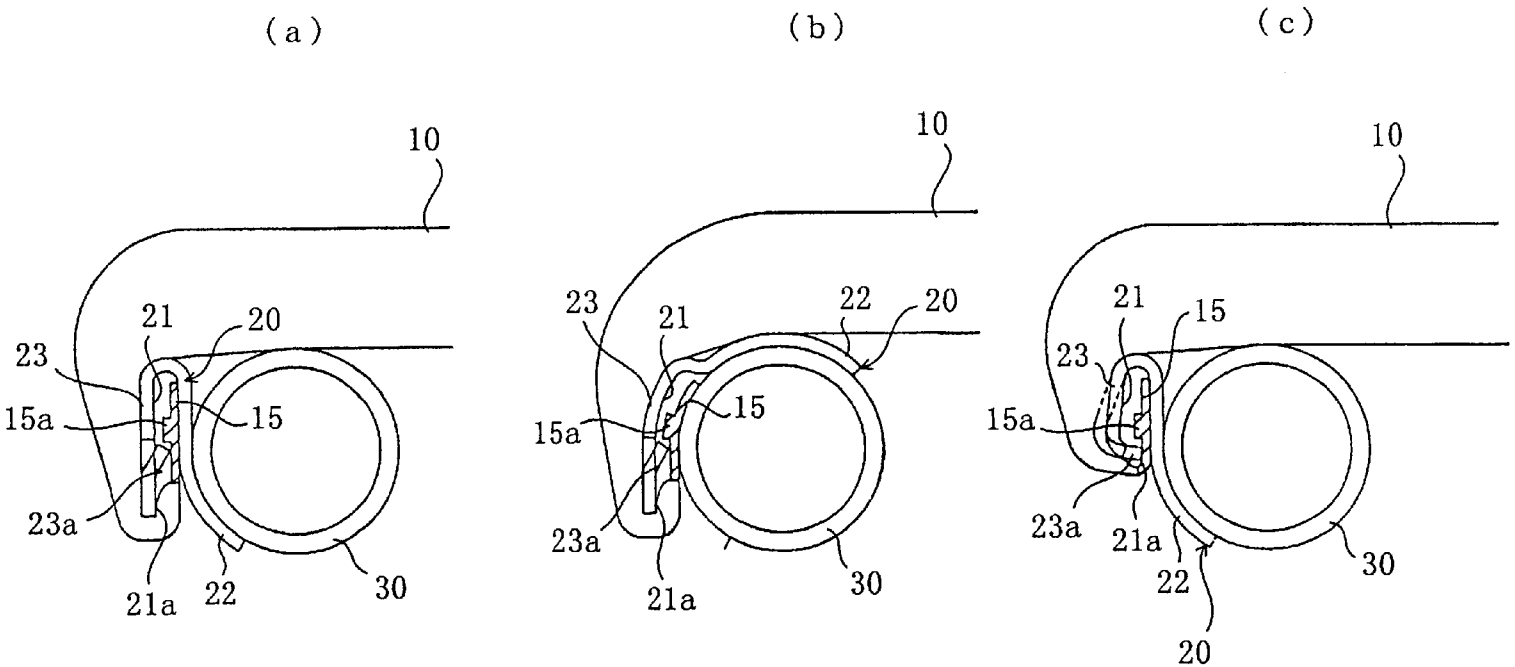
FIGS. 5(*a*) to 5(*c*) each are a fragmentary schematic view showing the manner of holding an end section of a net member in an end holding member.
Figure 6:
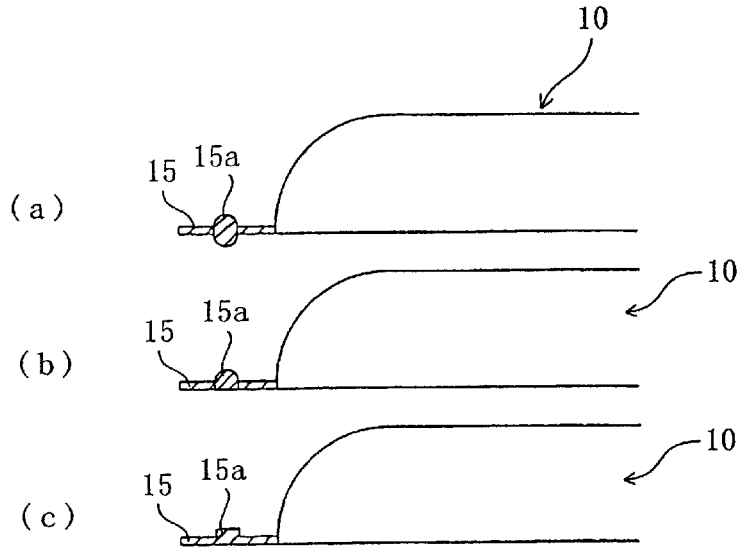
FIGS. 6(*a*) to 6(*c*) each are a schematic sectional view showing an end section of a net member treated according to a first example of a method according to the present invention.

In the illustrated embodiment, during the knitting, the end section 15 is formed on at least one surface thereof with a projection 15*a* in a manner to project in a thickness direction thereof and extend in a longitudinal direction thereof, as shown in FIGS. 5(*a*) to 6(*c*). A direction in which the projection 15*a* projects, a configuration of the projection 15*a* and the number of projections 15*a* are not subject to any restriction. Thus, the projection 15*a* may be formed in various manners, for example, as shown in FIGS. 6(*a*) to 6(*c*). Also, in the illustrated embodiment, as shown in FIGS. 5(*a*) to 5(*c*), the end section 15 of the net member 10 is inserted into the insertion gap 21 to a degree sufficient to permit the projection 15*a* to be positioned deeply beyond the pawl 23*a* formed on the end holding member 20. This results in the projection 15*a* being caught by the pawl 23*a*, to thereby prevent the end section 15 from being readily detached from the insertion gap 21, even when tension is applied to the net member 10 in a direction in which the end section 15 is removed from the insertion gap 21.

The knitting of the net member 10 which permits the portion of the net member constituting the end section 15 to have enhanced density may be carried out in a variety of ways. For example, the knitting may be carried out using a means of reducing intervals at which the piles 13 are knitted with respect to the front mesh layer 11 and rear mesh layer 12 as compared with those at which knitting inside the end section 15 is carried out, to thereby decrease intervals between the piles 13 adjacent to each other. Also, it may be carried out by a means of reducing a mesh size of the front mesh layer 11 and/or rear mesh layer 12 at only the portion of the net mesh 10 constituting the end section 15. Alternatively, it may be attained using a means of increasing a thickness of monofilaments for the front mesh layer 11, rear mesh layer 12 and/or piles 13 of the portion of the net member 10 constituting the end section 15. A further means is to construct a yarn (a multi-layer yarn or twisted yarn) into the front mesh layer 11, rear mesh layer 12 and/or piles 13 of the portion of the net member 10 constituting the end section 15. Also, any combination of the means described above may be suitably employed.

The heat welding may be carried out by heat sealing, ultrasonic welding, vibration welding or the like. In particular, vibration welding is suitably used for ensuring positive welding of the net member 10 of a three-dimensional structure to and reducing a thickness of the net member 10 while increasing density thereof.

Figure 8:
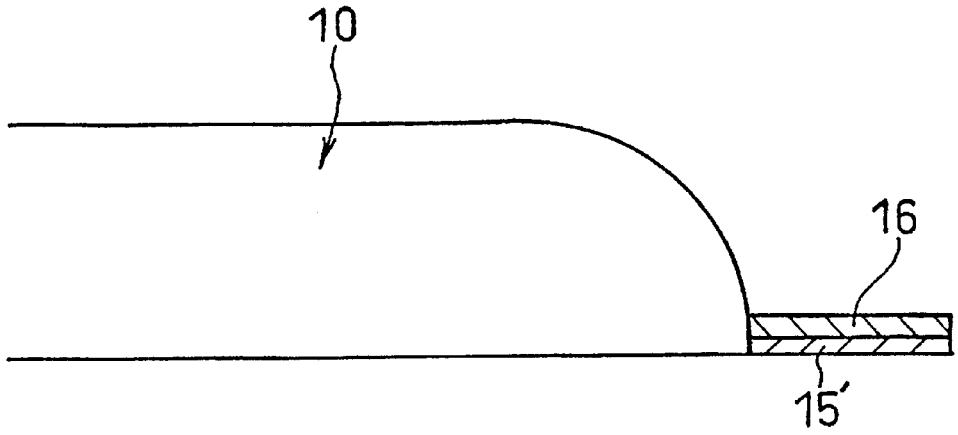
FIG. 8 is a schematic sectional view showing an end section of a net member treated according to a second example of a method according to the present invention.

An increase in rigidity of the end section 15 may be attained in such a manner as shown in FIG. 8. More particularly, an element 16 made of a synthetic resin material and formed into a width and a length corresponding to those of the end section 15 of the net member 10 is laminated on the end section 15 to form a laminate, which is then subjected to heat welding such as vibration welding or the like, resulting in both synthetic resin element 16 and end section 15 being fixedly joined together. In this instance as well, the front mesh layer 11, rear mesh layer 12 and/or piles 13 in the end section 15 of the net member 10 are joined to each other, so that the end section 15 may be reduced in the number of voids therein and formed into a configuration like a thin plate. Also, the end section 15, as described above, has the synthetic resin element 16 fixed thereto. Thus, the end section 15 may be securely held in the end holding element 20.

The net member 10 thus manufactured is schematically shown in FIG. 7. When the net member 10 thus knitted into a configuration of a continuous length is to be used as an article of any desired shape such as, for example, a cushioning member for a seat as indicated at phantom lines in FIG. 7, it is cut into a configuration which permits it to be stretchedly arranged on a frame for the seat. At this time, for example, when the net member 10 has a width increased sufficiently to provide two cushioning members for a seat, it is divided into two halves at a central position in a width direction thereof. This permits one end section 15 of each of the halves to be increased in density. However, this fails to permit the other end section 15' opposite to the end section 15 or a portion thereof adjacent to a dividing line C to be increased in density. Thus, in this instance, the other end section 15' of each of the two halves is treated in such a manner that the synthetic resin element 16 is joined to the end section 15' and then subjected to heat welding such as vibration welding or the like.

Thus, when the one end section 15 is treated by the above-described first method wherein the net structure of the end section 15 is rendered dense and then subjected to vibration welding and the other end section 15' is treated by the second method of subjecting the synthetic resin element 16 to vibration welding, the other end section 15' to which the synthetic resin element 16 is fixed is hard to deform to a degree sufficient to prevent removal thereof from the insertion gap 21 of the end holding member 20 as compared with the one end 15, when the end sections each are inserted into the insertion gap 21. Therefore, in such construction, it is preferable that the one end section 15 is held in the end holding member 20 arranged on a side on which stress occurring in the holding element 23 due to application of load thereto is reduced and the other end section 15' is held in the end holding member 20 arranged on a side on which stress occurring in the holding element 23 due to application of load thereto is increased.

Figure 10:
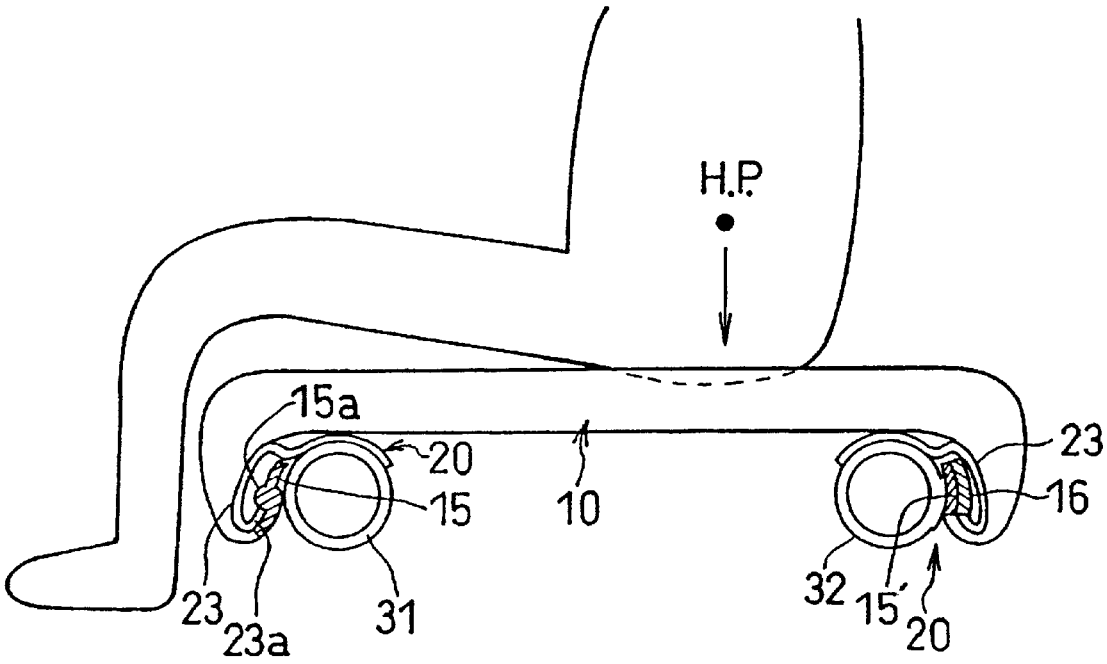
FIG. 10 is a schematic view showing application of a structural unit according to an embodiment of the present invention to a seat.

For example, when the net member 10 described above is to be stretchedly arranged on the frame so as to act as a cushioning member constituting a cushion section for a vehicle seat, the net member 10 is arranged between the end holding member 20 mounted on a frame 31 forwardly positioned and that mounted on a frame 32 rearwardly positioned, as shown in FIG. 10. In this instance, a hip point (HP) of the body of a person sit down on the net member 10 is rather rearwardly positioned. Thus, stress occurring in the holding element 23 of the end holding member 20 due to sitting-down of a person on the net member 10 is increased in the end holding member 20 mounted on the rearwardly arranged frame 32 as compared with that on the forwardly arranged frame 31. Therefore, in this instance, it is preferable that the end section 15 treated by the first method described above is held in the end holding member 20 mounted on the forwardly positioned frame 31 so that the projection 15*a* is engaged with the pawl 23*a* of the end holding member 20 and the end section 15' treated by the second method described above is held in the end holding member 20 mounted on the rearwardly positioned frame 32 so that the synthetic resin element 16 is engaged at a lower end thereof with the pawl 23*a* of the end holding member 20.

Figure 9:
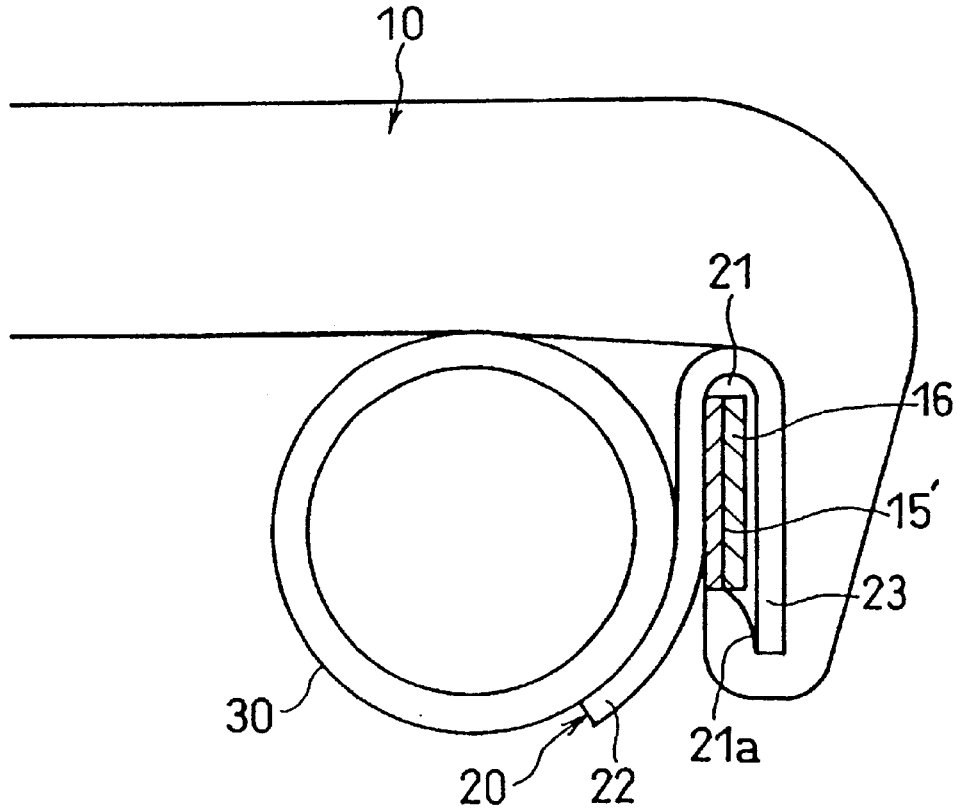
FIG. 9 is a schematic sectional view showing the manner of holding the treated end section shown in FIG. 8 on an end holding member.

When the end section is treated by the above-described second method of subjecting the synthetic resin element 16 to vibration welding, the end section inserted into the insertion gap 21 of the end holding member 20 is hard to be removed therefrom. Thus, in this instance, the end holding member 20 may be free from the pawl projecting into the insertion gap 21, as shown in FIG. 9.

The end section of the net member 10, when the structural unit of the illustrated embodiment is used as a seat for a vehicle, is preferably constituted by a combination of the end section 15 treated by the first method and the end section treated by the second method. This is for the reason that the frame 31 forwardly positioned is generally curved at a corner thereof, resulting in being rounded, therefore, fixing of the synthetic resin element 16 to the end section renders mounting of the end holding member 20 on the frame 31 difficult. Another reason is that stress occurring in the end holding member 20 mounted on the forwardly positioned frame 31 is decreased. However, when the structural unit of the illustrated embodiment is directed to other applications, such construction is not necessarily required. Thus, in this instance, all end sections may be treated by either the first method or the second method.

Also, when the structural unit of the illustrated embodiment is used as a seat for a vehicle, it is required that end sections 17 (FIG. 7) of the net member 10 on both sides thereof are fixed to a side frame (not shown) constituting a seat cushion section. In this instance, the end sections 17 on both sides are reduced in thickness by heat welding such as vibration welding or the like while keeping such an end holding member 20 as shown in FIG. 4 mounted on the side frame in alignment therewith, resulting in rigidity thereof being increased. Also, the end sections 17 each are formed on one surface thereof with a projection for holding. In each of the end sections 17 on both sides, the net structure is not densely constructed. However, it may be reduced in thickness by vibration welding or the like, to thereby be formed into a plate-like configuration which exhibits enhanced rigidity. This permits the end section 17 to be increased in rigidity to a degree sufficient to prevent it from being detached from the insertion gap in view of stress applied to the end holding member 20 arranged on the side frame.

In the illustrated embodiment, the end sections 15, 15' and 17 of the net member 10 of a three-dimensional structure, as described above, are treated by heat welding such as vibration welding or the like so as to exhibit reduced cushioning characteristics and increased rigidity as compared with a portion thereof positioned inside the end sections. Thus, when the end holding member 20 is arranged on the frame 30 constituting a part of the structural unit so that the insertion port 21*a* of the insertion gap 21 is arranged in the above-described specific direction or posture, the net member 10 may be readily held on the frame 30 by merely inserting the end sections 15, 15' and 17 into the insertion gap 21. Also, the end sections 15, 15' and 17 treated as described above each are entirely inserted into the insertion gap 21, to thereby permit load to be applied to the holding element 23 of the end holding member 20 in a two-dimensional manner rather than a dot-like manner. This effectively prevents damage to the net member 10 due to local application of undue force to any specific portion thereof as encountered in the prior art. Also, spot fastening of the net member such as fastening thereof to corners of the structural unit which is carried out in the prior art often causes waving of the net member, wrinkling thereof and the like. On the contrary, the illustrated embodiment effectively eliminates such problems, to thereby ensure improved aesthetic properties.

The present invention is not limited to the embodiment described above. The above description has been made substantially in connection with application of the structural unit having the three-dimensional net member 10 incorporated therein to a seat for a vehicle. However, the present invention may be effectively applied to a chair for a furniture such as a study desk, an office desk or the like, a seat for a theater or the like and other structural units other than a seat.

Figure 11:
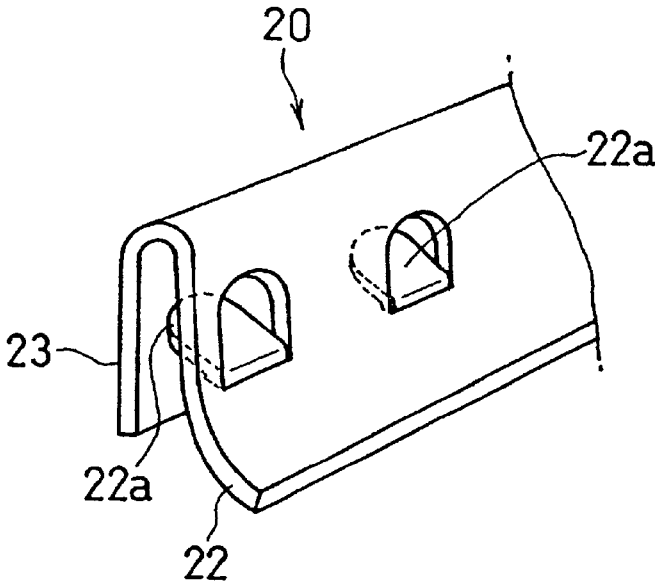
FIG. 11(*a*) is a fragmentary schematic perspective view showing another example of an end holding member.
Figure 11:
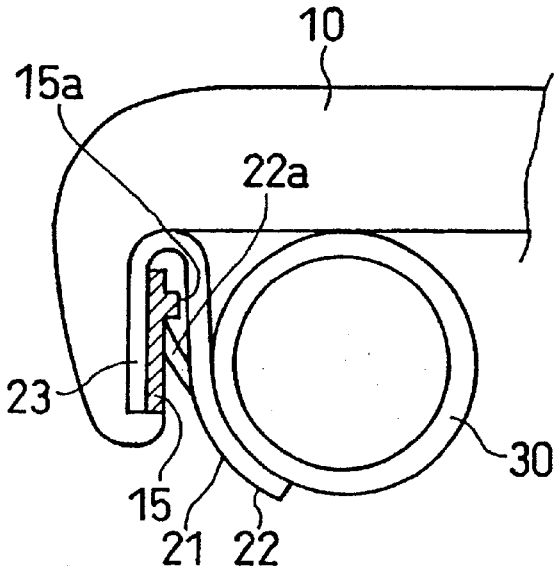
Figure 12:
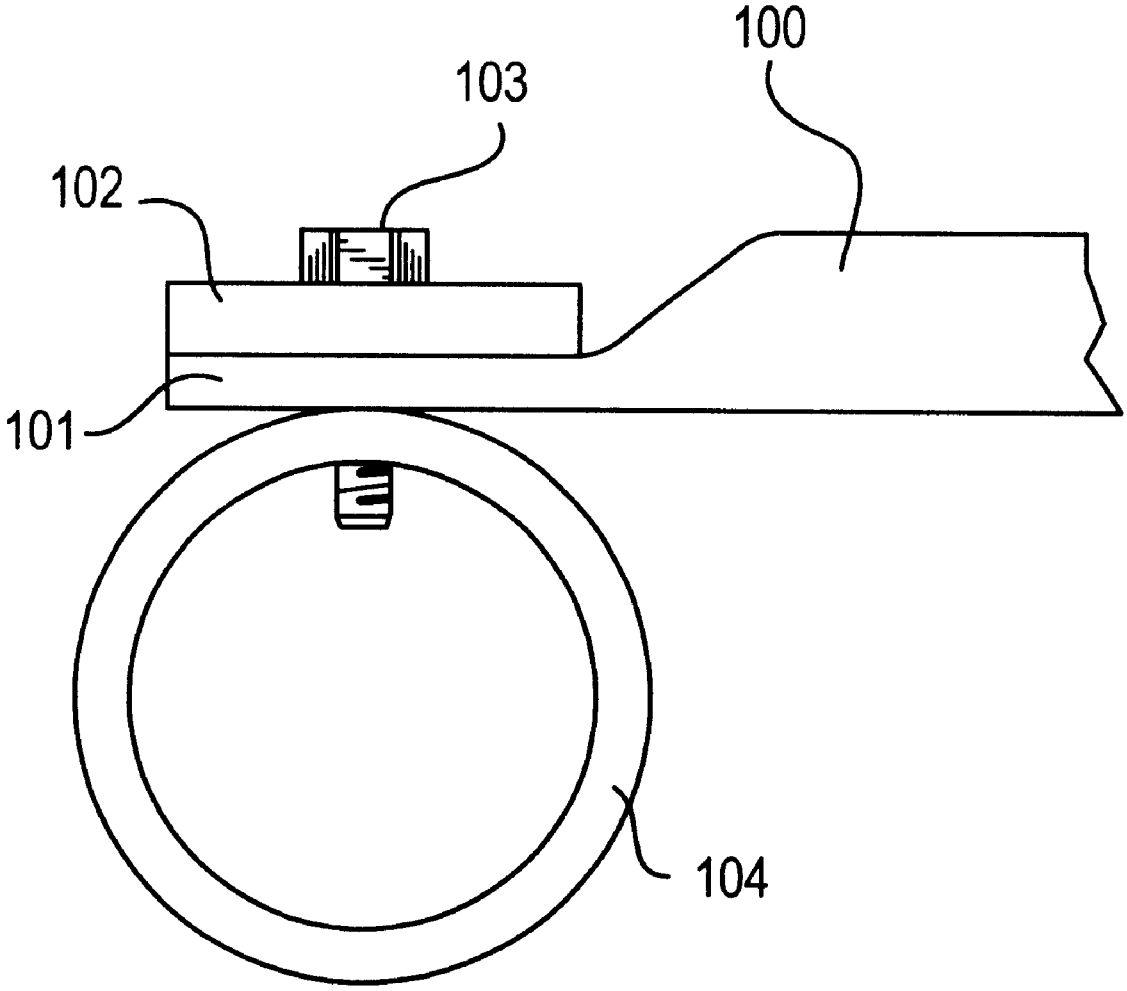
FIG. 12 PRIOR ART
FIG. 12 is a fragmentary schematic view showing the manner of fastening an end section of a net member to a frame which is conventionally practiced.

The end holding member 20, as shown in FIG. 11(*a*), may be so constructed that the base element 22 is formed thereon with the pawls 22*a* in a manner to project into the insertion gap 21. Also, the projection 15*a* of the end section 15 of the net member 10 may be arranged in conformity to such arrangement of each of the pawls 22*a*. Such construction permits each of the pawl 22*a* to be positioned in a direction in which the projection 15*a* escapes, to thereby further enhance engagement therebetween. Also, the pawl projecting into the insertion gap 21 may be provided on each of the base element 22 and holding element 23.

As can be seen form the foregoing, the structural unit having the net member of a three-dimensional structure incorporated therein, the seat constituted by the structural unit and the method for treating the end section of the net member according to the present invention eliminate spot-fastening of the net member to the frame which is conventionally carried out using a screw, to thereby prevent undue force from being locally applied to the net member, resulting in enhancing reliability of the net member. Also, stretched arrangement of the net member is attained by merely inserting the end section of the net member into the insertion gap of the end holding member, to thereby facilitate assembling of the structural unit and reduce a manufacturing cost.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A structural unit comprising:

a net member of a three-dimensional structure constituted by a front mesh layer, a rear mesh layer and a plurality of piles arranged between said front mesh layer and said rear mesh layer so as to connect said front mesh layer and rear mesh layer to each other therethrough;

said net member being formed on a periphery thereof with an end section; and an end holding member for supporting said end section of said net member therein;

said end holding member including a holding element formed therein with an insertion gap into which said end section of said net member is inserted;

said end section of said net member being treated so that at least a part thereof has a net structure increased in density and rigidity as compared with a portion of said net member positioned inside said end section, resulting in being held in said end holding member due to insertion thereof into said insertion gap of said end holding member;

wherein said end section is treated so as to be reduced in thickness by heat welding, so that said net structure is increased in density and rigidity; and wherein said end section is subject to said heat welding after said end section is previously knitted so as to increase density of said net structure.

2. A structural unit as defined in claim 1, wherein said insertion gap of said end holding member has an insertion port arranged in a posture which permits said end section of said net member to be inserted into said insertion gap therethrough while keeping said end section inwardly folded.

3. A structural unit as defined in claim 1, wherein said end section treated so that said net structure is increased in density and rigidity is formed on at least one surface thereof with a projection;

said holding element is provided thereon with a pawl in a manner to project into said insertion gap of said end holding member; and said end section is inserted into said insertion gap so that said projection is positioned deeply beyond said pawl in said insertion gap, resulting in being held in said insertion gap.

4. A structural unit as defined in claim 1, wherein said heat welding is carried out by vibration welding.

5. A seat constituted by a structural unit as defined in claim 1.

6. A method for treating an end section of a net member, comprising the steps of:

reducing a thickness of an end section formed on a periphery of a net member of a three-dimensional structure by heat welding so as to hold said end section in an end holding member, resulting in a net structure of said end section being increased in density and rigidity as compared with a portion of said net member positioned inside said end section;

said net member being constituted by a front mesh layer, a rear mesh layer and a plurality of piles arranged between said front mesh layer and said rear mesh layer so as to connect said front mesh layer and rear mesh layer to each other therethrough; and wherein said end section is subject to said heat welding after said end section is previously knitted so as to increase density of said net structure.

7. A method as defined in claim 6, wherein said end section is formed thereon with a projection in a manner to project in a thickness direction thereof during said heat welding of said end section.

8. A method as defined in claim 6, wherein said heat welding is carried out by vibration welding.

* * * * *